US012693060B2

(12) United States Patent
Bruton

(10) Patent No.: US 12,693,060 B2
(45) Date of Patent: Jul. 28, 2026

(54) PORTABLE COOLER ASSEMBLY

(71) Applicant: Dylan Bruton, Lafayette, CO (US)

(72) Inventor: Dylan Bruton, Lafayette, CO (US)

( * ) Notice: Subject to any disclaimer, the term of this patent is extended or adjusted under 35 U.S.C. 154(b) by 526 days.

(21) Appl. No.: 18/142,666

(22) Filed: May 3, 2023

(65) Prior Publication Data

US 2024/0369280 A1 Nov. 7, 2024

(51) Int. Cl.
*F25D 3/08* (2006.01)

(52) U.S. Cl.
CPC ..... *F25D 3/08* (2013.01)

(58) Field of Classification Search
CPC ... F25D 3/08; F25D 2400/38; B65D 81/2076; B65D 25/10; B65D 25/282; B65D 81/3813; Y02A 40/963; B60P 3/205
See application file for complete search history.

(56) References Cited

U.S. PATENT DOCUMENTS

| | | | | |
|---|---|---|---|---|
| 4,213,309 | A | 7/1980 | Pifer | |
| D322,738 | S | 12/1991 | Onweiler | |
| 6,193,097 | B1 * | 2/2001 | Martin Perianes | B65D 81/3823 220/501 |
| 6,966,450 | B2 | 11/2005 | Askew | |
| 8,479,947 | B1 | 7/2013 | Albrecht, II | |
| 9,108,790 | B2 | 8/2015 | Daley | |
| 10,443,918 | B2 | 10/2019 | Li | |
| 11,267,637 | B2 | 3/2022 | Barfoot | |
| 2009/0045204 | A1 | 2/2009 | Marganski | |
| 2018/0149400 | A1 * | 5/2018 | Valencia | F25D 3/06 |
| 2018/0265257 | A1 * | 9/2018 | Summers | F25D 3/08 |
| 2023/0112280 | A1 * | 4/2023 | Banal | B62B 5/067 62/457.7 |

FOREIGN PATENT DOCUMENTS

| | | |
|---|---|---|
| WO | WO2008057914 | 5/2008 |

* cited by examiner

*Primary Examiner* — Frantz F Jules
*Assistant Examiner* — Martha Tadesse

(57) ABSTRACT

A portable cooler assembly includes a cooler that is comprised of a thermally insulating material wherein the cooler is configured to store ice and food items. The cooler has an upper chamber that is fluidly discrete from a lower chamber. The cooler includes a lid and a pair of first latches pivotally coupled to the lid which releasably engages the cooler for retaining the lid in a closed position. A mesh grill is positioned in the upper chamber in the cooler and food items can be placed upon the mesh grill. The mesh grill is spaced upwardly in the upwardly chamber to inhibit the food items from being exposed to water from melted ice. A drawer is slidably integrated into the cooler to contain food items.

12 Claims, 6 Drawing Sheets

PORTABLE COOLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cooler devices and more particularly pertains to a new cooler device for transporting beverage containers and food items that must be kept cool. The device includes a cooler that has an upper chamber and a lower chamber. The device includes a drawer integrated into the upper chamber and a mesh grill that is spaced upwardly from a bottom of the lower chamber. Ice can be positioned beneath the mesh grill and the food items and beverage containers can be placed on the mesh grill to elevate the food items and the beverage containers above water from the melted ice.

(2) Description of Related Art Including Information Disclosed Under 37 CFR 1.97 and 1.98

The prior art relates to cooler devices including a variety of portable coolers that each has an adjustable partition for dividing an interior of the portable coolers into sections. In one particular instance the prior art discloses a portable cooler that combines adjustable partitions with receptacles integrated into the portable cooler and a lid of the portable cooler for receiving ice packs. In no instance does the prior art disclose a portable cooler that has an upper chamber that is fluidly discrete with a lower chamber, a drawer integrated into the cooler and a mesh grill disposed in the upper chamber for supporting food objects above water from melted ice.

BRIEF SUMMARY OF THE INVENTION

An embodiment of the disclosure meets the needs presented above by generally comprising a cooler that is comprised of a thermally insulating material wherein the cooler is configured to store ice and food items. The cooler has an upper chamber that is fluidly discrete from a lower chamber. The cooler includes a lid and a pair of first latches pivotally coupled to the lid which releasably engages the cooler for retaining the lid in a closed position. A mesh grill is positioned in the upper chamber in the cooler and food items can be placed upon the mesh grill. The mesh grill is spaced upwardly in the upwardly chamber to inhibit the food items from being exposed to water from melted ice. A drawer is slidably integrated into the cooler to contain food items.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
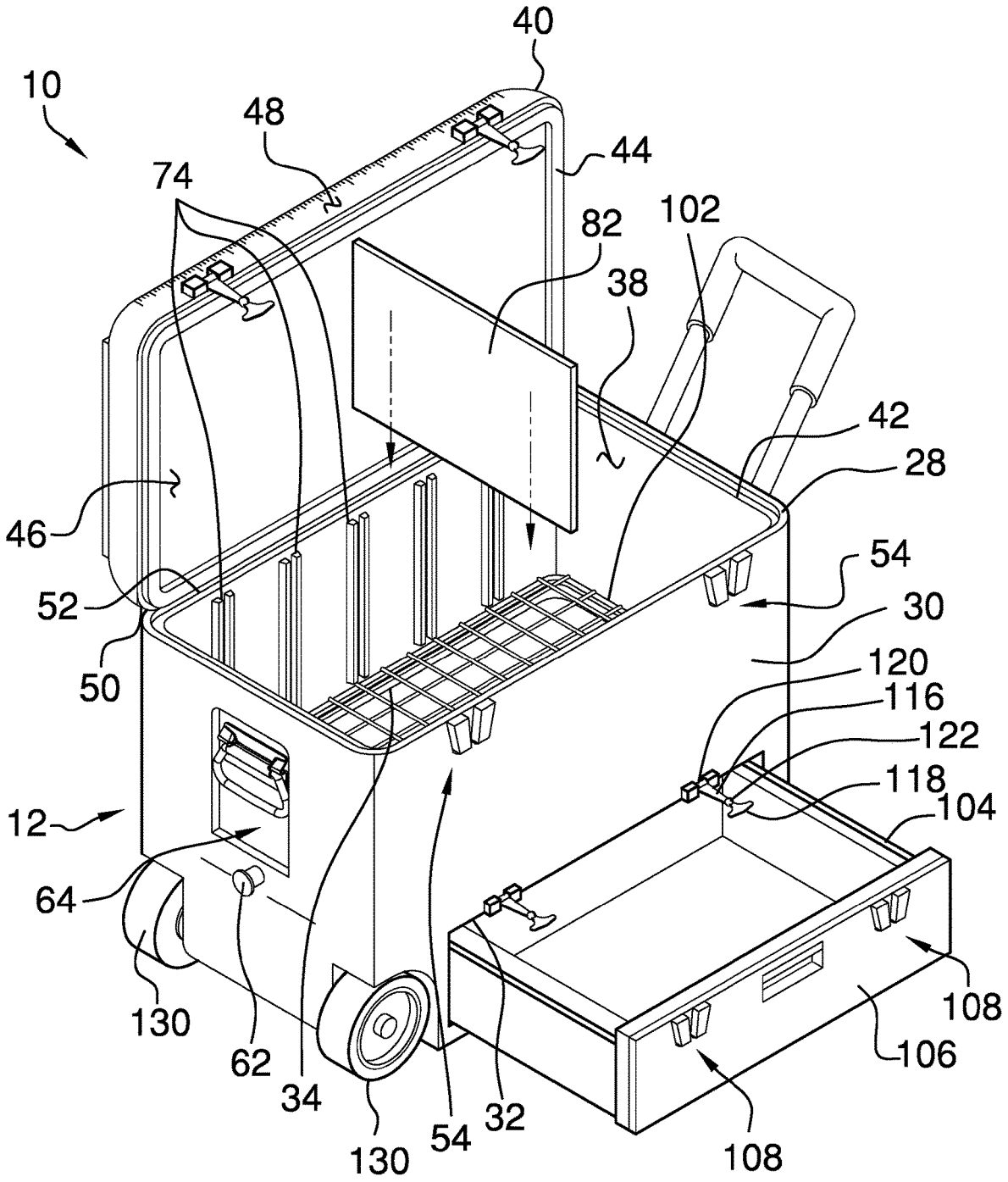
FIG. 1 is a top perspective view of a portable cooler assembly according to an embodiment of the disclosure.
Figure 2:
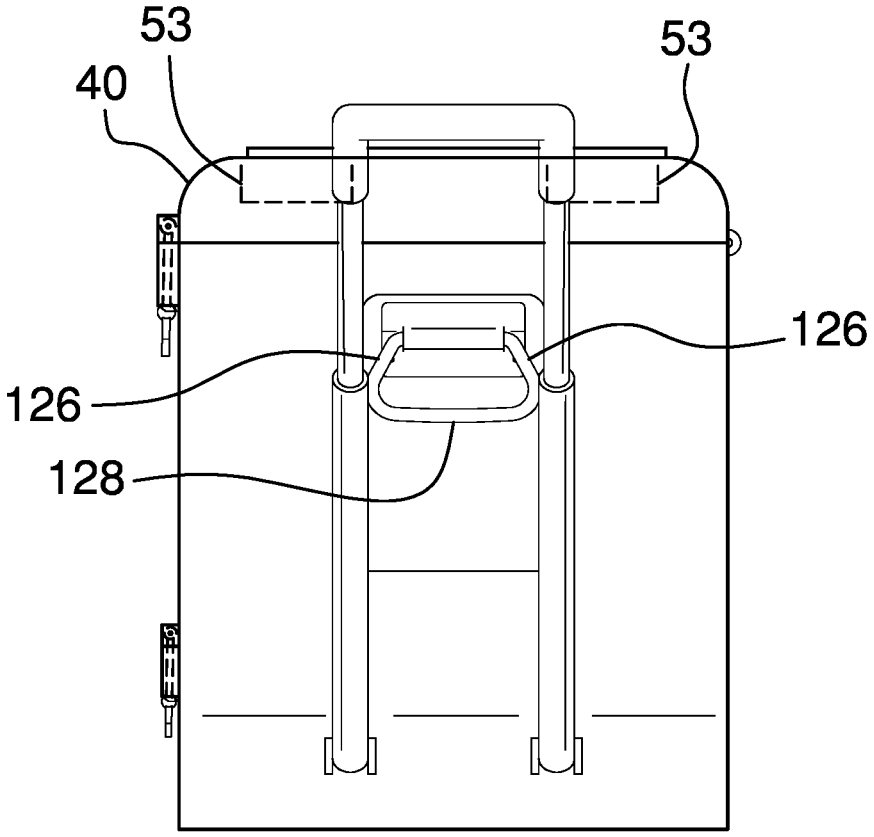
FIG. 2 is a left side view of an embodiment of the disclosure.
Figure 3:
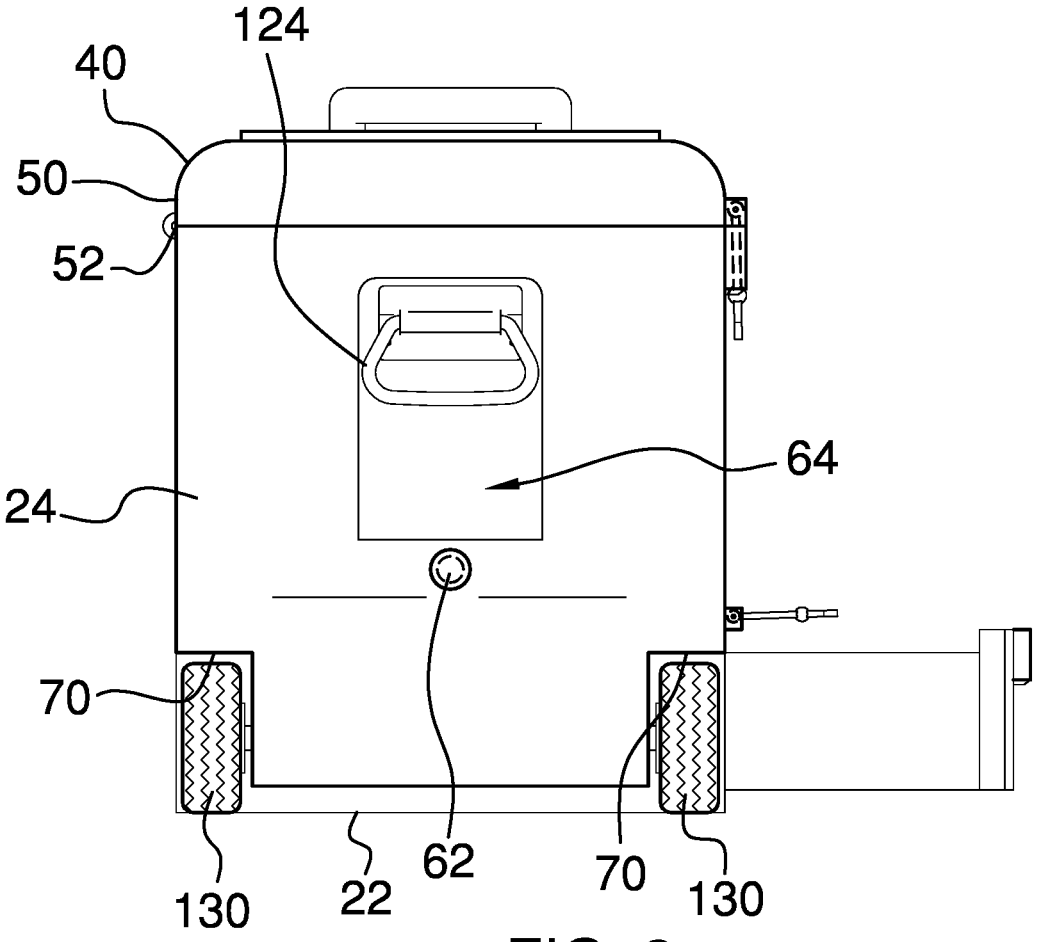
FIG. 3 is a right side view of an embodiment of the disclosure.
Figure 4:
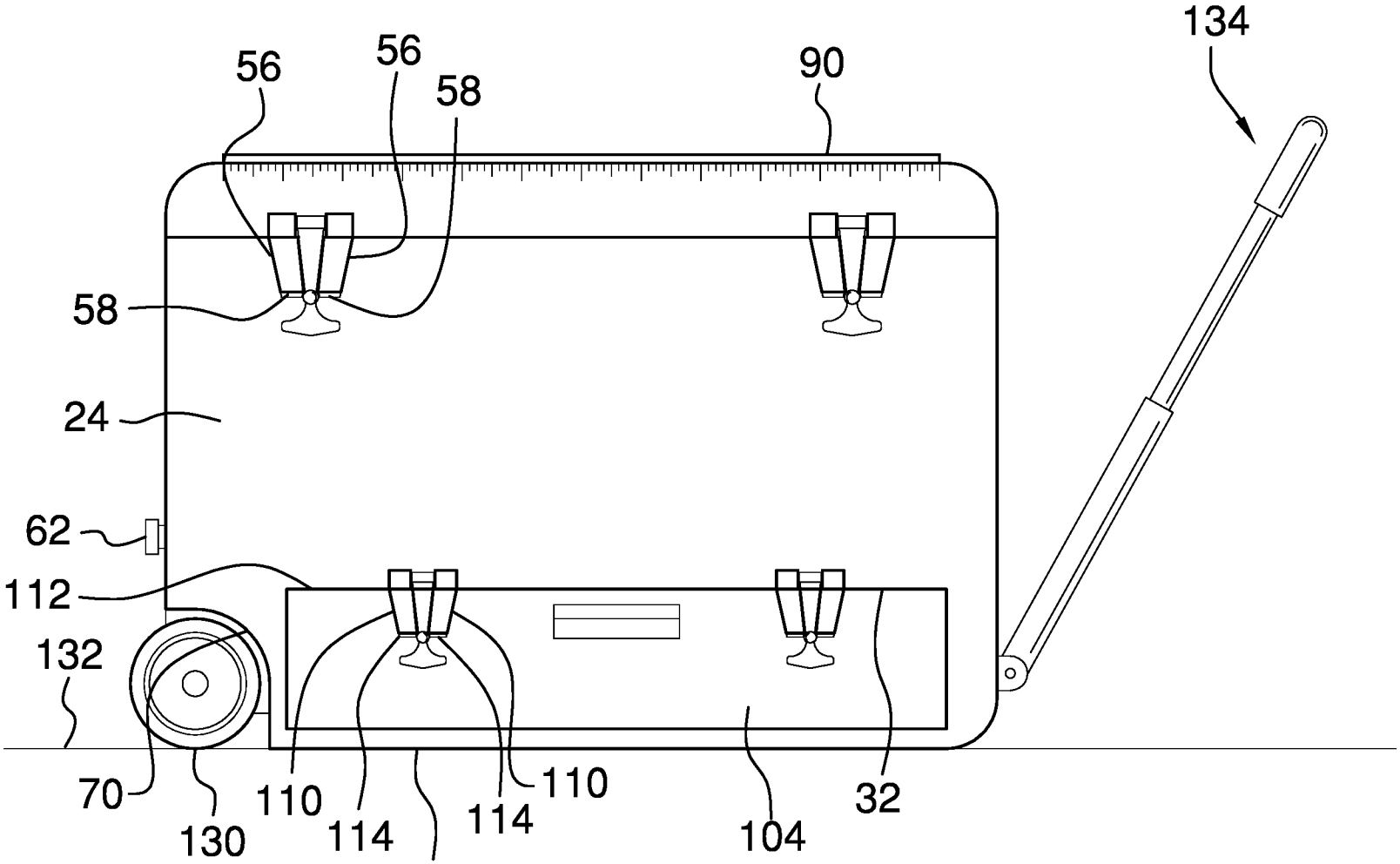
FIG. 4 is a front view of an embodiment of the disclosure.
Figure 5:
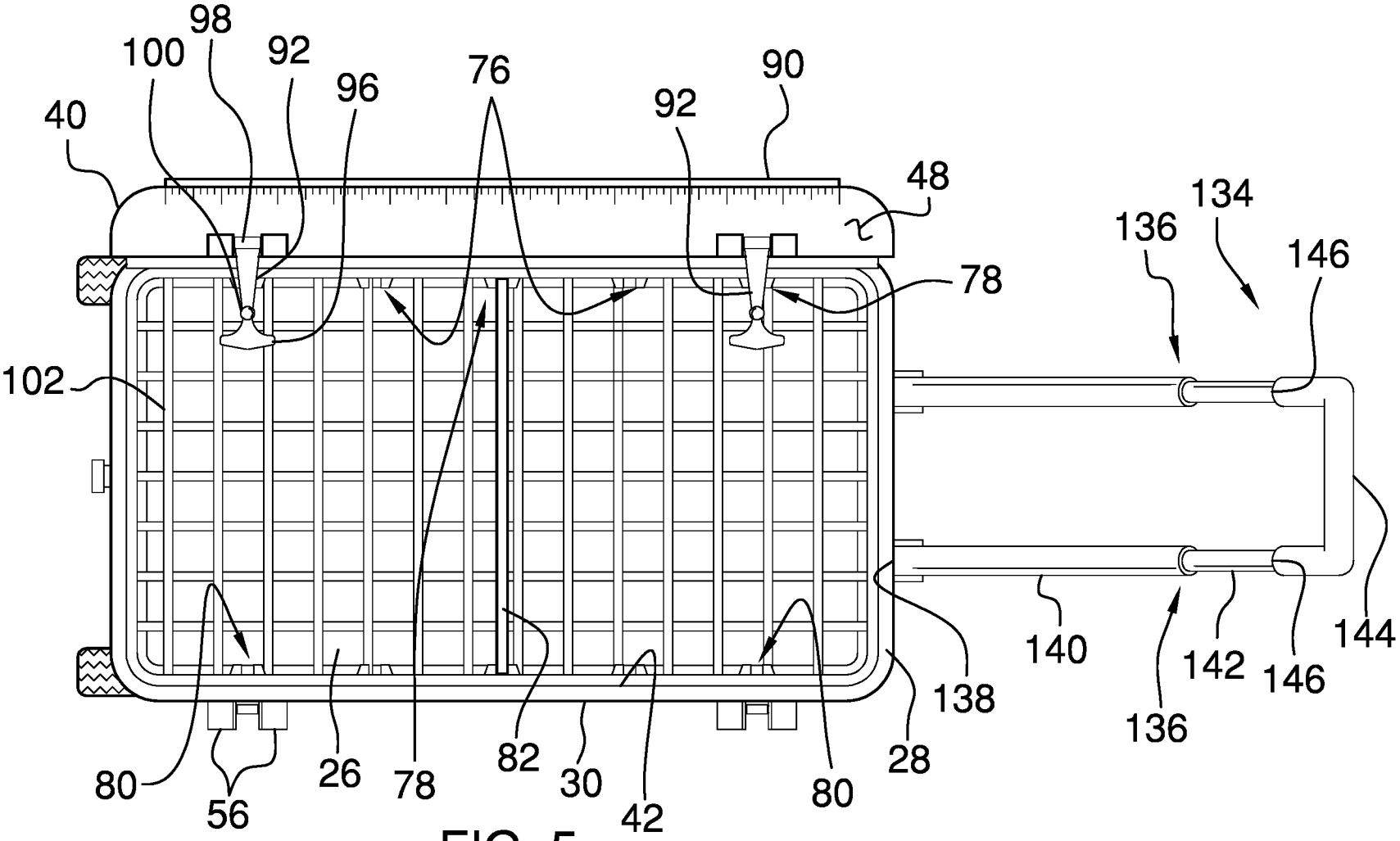
FIG. 5 is a top view of an embodiment of the disclosure.
Figure 6:
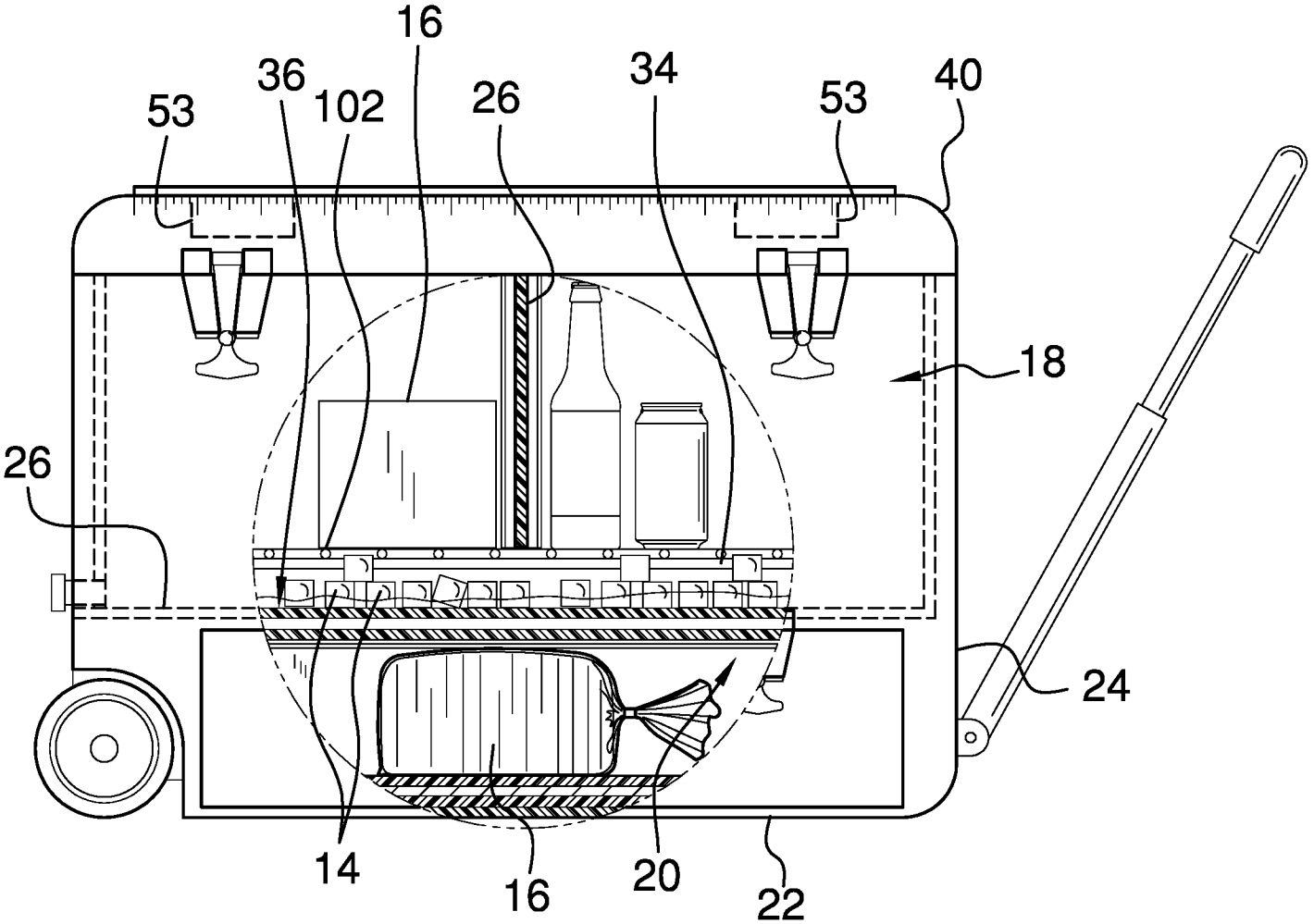
FIG. 6 is a front cut-away view of an embodiment of the disclosure.

With reference now to the drawings, and in particular to FIGS. 1 through 6 thereof, a new cooler device embodying the principles and concepts of an embodiment of the disclosure and generally designated by the reference numeral 10 will be described.

As best illustrated in FIGS. 1 through 6, the portable cooler assembly 10 generally comprises a cooler 12 that is comprised of a thermally insulating material to store ice 14 and food items 16. Additionally, the cooler 12 has an upper chamber 18 that is fluidly discrete from a lower chamber 20. The cooler 12 has a lower wall 22 and an outer wall 24 extending upwardly from the lower wall 22 and the cooler 12 has a dividing wall 26 that is spaced from and lies on a plane that is oriented parallel to the lower wall 22. The upper chamber 18 is defined between the dividing wall 26 and a top edge 28 of the outer wall 24 and the lower chamber 20 is defined between the dividing wall 26 and the lower wall 22. Additionally, a front side 30 of the outer wall 24 has an opening 32 extending into the lower chamber 20. The dividing wall 26 has a lip 34 extending upwardly from a top surface 36 of the dividing wall 26 and the lip 34 on the dividing wall 26 extends around a full perimeter of an interior surface 38 of the outer wall 24.

The cooler 12 includes a lid 40 that is hingedly coupled to the top edge 28 of the outer wall 24. The top edge 28 has a recess 42 extending toward the lower wall 22 and the recess 42 is aligned with the interior surface 38 of the outer wall 24. Furthermore, the recess 42 extends around a full perimeter of the top edge 28. The lid 40 has a lip 44 extending away from a bottom surface 46 of the lid 40; the lip 44 on the lid 40 extends around a full perimeter of the lid 40 and the lip 44 on the lid 40 is offset from an outer surface 48 of the lid 40. The lip 44 on the lid 40 fits into the recess 42 in the top edge 28 of the outer wall 24 when the lid 40 is closed to inhibit thermal communication between an interior of the cooler 12 and ambient air. A rear side 50 of the outer surface 48 of the lid 40 is hingedly coupled to a rear side 52 of the top edge 28 of the outer wall 24 of the cooler 12. The lid 40 has a pair of cup holders 53 each recessed into the lid 40 for holding drinks.

The cooler 12 has a pair of first engaging elements 54 each extending away from the front side 30 of the outer wall 24 of the cooler 12 and each of the first engaging elements 54 is aligned with the top edge 28 of the outer wall 24. Each of the first engaging elements 54 includes pair of blocks 56 which are spaced apart from each other and angle toward each other between the top edge 28 of the outer wall 24 and a bottom end 58 of the blocks 56. Indicia 60 are printed on the front side 30 of the outer surface 48 of the lid 40 and the indicia 60 comprise a graduated scale defining a ruler.

The cooler 12 has a drain 62 extending through the outer wall 24 and the drain 62 is in fluid communication with the upper chamber 18 in the cooler 12 to drain 62 water from the upper chamber 18. The drain 62 is actuatable between a closed condition and an open condition. The outer wall 24 of the cooler 12 has a pair of handle wells 64 each extending into a respective one of a first lateral side 66 and a second lateral side 68 of the outer wall 24. The outer wall 24 of the cooler 12 has a pair of wheel wells 70 each recessed into an intersection between the first lateral side 66 of the outer wall 24 and a respective one of a rear side 72 and the front side 30 of the outer wall 24. Continuing, the cooler 12 has a plurality of ridges 74 each extending away from the interior surface 38 of the outer wall 24 and each of the plurality of ridges 74 extends substantially between the top edge 28 of the outer wall 24 and the dividing wall 26.

The plurality of ridges 74 is arranged into a plurality of pairs of ridges 76 and respective ones of the ridges 74 which comprise each of the pairs of ridges 76 is spaced apart from each other. The plurality of pairs of ridges 76 is spaced apart from each other and is evenly distributed between the first lateral side 66 and the second lateral side 68 of the outer wall 24. Furthermore, the plurality of pairs of ridges 76 includes a set of first ridges 78 and a set of second ridges 80. The set of first ridges 78 is disposed on the rear side 72 of the outer wall 24 and the set of second ridges 80 is disposed on the front side 30 of the outer wall 24.

A dividing panel 82 is insertable between respective ones of the set of first ridges 78 and the second ridges 80 for dividing the upper chamber 18 into a first section 84 and a second section 86. The dividing panel 82 can keep beverage containers 88 separated from food items 16. A cutting board 90 is integrated into a top surface of the lid 40 and the cutting board 90 is comprised of a resilient material to facilitate food to be cut or chopped on the cutting board 90.

A pair of first latches 92 is each pivotally coupled to the lid 40 and each of the first latches 92 is disposed on a front side 94 of the outer surface 48 of the lid 40. Each of the first latches 92 has a handle 96 that is distally positioned with respect to a pivot point 98 of the first latches 92 and a ball 100 that is positioned closer to the handle 96 than the pivot point 98. Each of the first latches 92 is positioned between the pair of blocks 56 associated with a respective one of the first engaging elements 54 on the outer wall 24 of the cooler 12 when the lid 40 is closed and when the pair of first latches 92 is moved into a locking position; the ball 100 associated with each of the first latches 92 abuts the bottom end 58 of the pair of blocks 56 associated with the respective first engaging element 54 for retaining the lid 40 in a closed position. Each of the first latches 92 is displaced from the pair of blocks 56 associated with the respective first engaging element 54 when the first latches 92 are moved into an unlocked position thereby facilitating the lid 40 to be opened.

A mesh grill 102 is positioned in the upper chamber 18 in the cooler 12 and the food items 16 are placed upon the mesh grill 102. The mesh grill 102 is spaced upwardly in the upward chamber 18 to elevate the food items 16 thereby inhibiting the food items 16 from being exposed to water from melted ice 14. The mesh grill 102 lies on the lip 34 on the dividing wall 26 such that the mesh grill 102 is spaced from the dividing wall 26 to accommodate ice cubes 14 positioned between the mesh grill 102 and the dividing wall 26. In this way the food items 16 in the upper chamber 18 can be kept cold.

A drawer 104 is slidably integrated into the cooler 12 and the drawer 104 can contain food items 16. The drawer 104 is positioned in the lower chamber 20 when the drawer 104 is closed and the drawer 104 slides into the opening 32 in the front side 30 of the outer wall 24 of the cooler 12. A front wall 106 of the drawer 104 lies on a plane that is coplanar with the front side 30 of the outer wall 24 of the cooler 12 when the drawer 104 is closed. Additionally, the drawer 104 is comprised of a thermally insulating material to inhibit thermal communication between the food items 16 in the drawer 104 and ambient air when the drawer 104 is closed. The drawer 104 has a pair of second engaging elements 108 each extending away from the front wall 106 of the drawer 104. Each of the second engaging elements 108 includes a pair of blocks 110 which are spaced apart from each other and angle toward each other between an upper edge 112 of the front wall 106 and a bottom end 114 of the blocks 110 associated with the second engaging elements 108.

A pair of second latches 116 is each pivotally coupled to the front side 30 of the outer wall 24 of the cooler 12. Each of the second latches 116 has a handle 118 that is distally positioned with respect to a pivot point 120 of the second latches 116 and a ball 122 that is positioned closer to the handle 118 than the pivot point 120. Each of the second latches 116 is positioned between the pair of blocks 56 associated with a respective one of the second engaging elements 108 on the front wall 106 of the drawer 104 when the drawer 104 is closed and the pair of second latches 116 is moved into a locking position; the ball 122 associated with each of the second latches 116 abuts the bottom end 114 of the pair of blocks 110 associated with the respective second engaging element 108 for retaining the drawer 104 in a closed position. Conversely, each of the second latches 116 is displaced from the pair of blocks 56 associated with the respective second engaging element 108 when the second latches 116 are moved into an unlocked position thereby facilitating the drawer 104 to be opened.

A pair of carrying handles 124 is each pivotally disposed in a respective one of the handle wells 64 in the outer wall 24 of the cooler 12 and each of the carrying handles 124 can be gripped for carrying the cooler 12. Each of the carrying handles 124 has a pair of lateral members 126 each pivotally coupled to the outer wall 24 of the cooler 12 and a central member 128 extending between the pair of lateral members 126. The central member 128 of each of the carrying handles 124 can be gripped for carrying the cooler 12. A pair of rollers 130 is each rotatably coupled to the cooler 12 to roll along a support surface 132 for transporting the cooler 12 along the support surface 132. Each of the rollers 130 is positioned in a respective one of the wheel wells 70 in the outer wall 24 of the cooler 12.

A pull handle 134 is pivotally coupled to the cooler 12 and the pull handle 134 can be gripped for rolling the cooler 12 on the pair of rollers 130. The pull handle 134 has a pair of first members 136 that each has a first end 138 which is pivotally attached to the second lateral side 68 of the outer wall 24 of the cooler 12. Each of the first members 136 has a first section 140 which slidably engages a second section 142 such that each of the first members 136 has a telescopically adjustable length. The pull handle 134 has a second member 144 extending between a second end 146 of each of the pair of first members 136 thereby facilitating the second member 144 to be gripped.

In use, ice 14 is poured into the upper chamber 18 such that the ice 14 is positioned beneath the mesh grill 102. The dividing panel 82 can be placed between selected ridges 74 for sequestering beverage containers 88 from food items 16 or the cooler 12 can be employed without the dividing panel 82. The food items 16 and the beverage containers 88 are placed on the mesh grill 102 thereby inhibiting the food items 16 and the beverage containers 88 from coming into contact with water from melted ice 14. In this way the food items 16 are protected from spoiling due to becoming soaked with the water from the melted ice 14. The lid 40 is closed and each of the first latches 92 is moved into the locking position to keep the lid 40 closed. Food items 16 that do not need to be kept cold can be stored in the drawer 104 and each of the second latches 116 can be moved into the locking position to keep the drawer 104 closed. The pull handle 134 can be gripped to roll the cooler 12 on the rollers to transport the cooler 12 or each of the carrying handles 124 can be gripped to carry the cooler 12. The drain 62 can be opened at any time to drain 62 water that collects beneath the mesh grill 102 as the ice 14 melts.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable cooler assembly for keeping food items from coming into contact with melted ice, said assembly comprising:

a cooler being comprised of a thermally insulating material wherein said cooler is configured to store ice and food items, said cooler having an upper chamber being fluidly discrete from a lower chamber, said cooler having a pair of first engaging elements, said cooler including a lid;

a pair of first latches, each of said first latches being pivotally coupled to said lid, each of said first latches releasably engaging a respective one of said first engaging elements for retaining said lid in a closed position;

a mesh grill being positioned in said upper chamber in said cooler wherein said mesh grill is configured to have food items placed upon said mesh grill, said mesh grill being spaced upwardly in said upwardly chamber wherein said mesh grill is configured to elevate the food items thereby inhibiting the food items from being exposed to water from melted ice;

a drawer being slidably integrated into said cooler wherein said drawer is configured to contain food items, said drawer being positioned in said lower chamber when said drawer is closed, said drawer being comprised of a thermally insulating material wherein said drawer is configured to inhibit thermal communication between the food items in said drawer and ambient air when said drawer is closed;

a pair of rollers, each of said rollers being rotatably coupled to said cooler wherein each of said rollers is configured to roll along a support surface for transporting said cooler along the support surface; and a pull handle being pivotally coupled to said cooler wherein said pull handle is configured to be gripped for rolling said cooler on said pair of rollers;

wherein said cooler has a lower wall and an outer wall extending upwardly from said lower wall, said cooler having a dividing wall being spaced from and lying on a plane being oriented parallel to said lower wall, said first chamber being defined between said dividing wall and a top edge of said outer wall, said second chamber being defined between said dividing wall and said lower wall;

wherein said top edge has a recess extending toward said lower wall, said recess being aligned with an interior surface of said outer wall, said recess extending around a full perimeter of said top edge; and wherein said lid is hingedly coupled to said top edge of said outer wall, said lid having a lip extending away from a bottom surface of said lid, said lip extending around a full perimeter of said lid, said lip being offset from an outer surface of said lid, said lip fitting into said recess in said top edge of said outer wall when said lid is closed wherein said lid is configured to inhibit thermal communication between an interior of said cooler and ambient air, a rear side of said outer surface of said lid being hingedly coupled to a rear side of said top edge of said outer wall of said cooler.

2. The assembly according to claim 1, further comprising said pair of first engaging elements each extends away from a front side of said outer wall of said cooler, each of said first engaging elements being aligned with said top edge of said outer wall, each of said first engaging elements including pair of blocks which are spaced apart from each other and angle toward each other between said top edge of said outer wall and a bottom end of said blocks.

3. The assembly according to claim 1, wherein:

said cooler has an outer wall, said outer wall of said cooler having a pair of handle wells each extending into a respective one of a first lateral side and a second lateral side of said outer wall; and said assembly includes a pair of carrying handles, each of said carrying handles being pivotally disposed in a respective one of said handle wells in said outer wall of said cooler wherein each of said carrying handles is configured to be gripped for carrying said cooler, each of said carrying handles having a pair of lateral members each being pivotally coupled to said outer wall of said cooler and a central member extending between said pair of lateral members wherein said central member is configured to be gripped.

4. The assembly according to claim 1, wherein:

said cooler has an outer wall, said outer wall having a first lateral side, a second lateral side and a front side;

said outer wall of said cooler has a pair of wheel wells each being recessed into an intersection between said first lateral side of said outer wall and a respective one of a rear side of said outer wall and said front side of said outer wall; and each of said rollers is positioned in a respective one of said wheel wells in said outer wall of said cooler.

5. The assembly according to claim 1, wherein:

said cooler has a lower wall and an outer wall extending upwardly from said lower wall, said cooler having a dividing wall being spaced from and lying on a plane being oriented parallel to said lower wall, said first chamber being defined between said dividing wall and a top edge of said outer wall, said second chamber being defined between said dividing wall and said lower wall; and said cooler has a plurality of ridges each extending away from said interior surface of said outer wall, each of said plurality of ridges extending substantially between said top edge of said outer wall and said dividing wall, said plurality of ridges being arranged into a plurality of pairs of ridges, respective ones of said ridges which comprise each of said pairs of ridges being spaced apart from each other, said plurality of pairs of ridges being spaced apart from each other and being evenly distributed between a first lateral side and a second lateral side of said outer wall.

6. The assembly according to claim 5, wherein said plurality of pairs of ridges includes a set of first ridges and a set of second ridges, said set of first ridges being disposed on a rear side of said outer wall, said set of second ridges being disposed on said front side of said outer wall.

7. The assembly according to claim 2, wherein:

each of said first latches is disposed on a front side of said outer surface of said lid, each of said first latches having a handle being distally positioned with respect to a pivot point of said first latches and a ball being positioned closer to said handle than said pivot point;

each of said first latches is positioned between said pair of blocks associated with a respective one of said first engaging elements on said outer wall of said cooler when said lid is closed and said pair of first latches is moved into a locking position having said ball associated with each of said first latches abutting said bottom end of said pair of blocks associated with said respective engaging element for retaining said lid in a closed position; and each of said first latches is displaced from said pair of blocks associated with said respective engaging element when said first latches are moved into an unlocked position thereby facilitating said lid to be opened.

8. A portable cooler assembly for keeping food items from coming into contact with melted ice, said assembly comprising:

a cooler being comprised of a thermally insulating material wherein said cooler is configured to store ice and food items, said cooler having an upper chamber being fluidly discrete from a lower chamber, said cooler having a pair of first engaging elements, said cooler including a lid;

a pair of first latches, each of said first latches being pivotally coupled to said lid, each of said first latches releasably engaging a respective one of said first engaging elements for retaining said lid in a closed position;

a mesh grill being positioned in said upper chamber in said cooler wherein said mesh grill is configured to have food items placed upon said mesh grill, said mesh grill being spaced upwardly in said upwardly chamber wherein said mesh grill is configured to elevate the food items thereby inhibiting the food items from being exposed to water from melted ice;

a drawer being slidably integrated into said cooler wherein said drawer is configured to contain food items, said drawer being positioned in said lower chamber when said drawer is closed, said drawer being comprised of a thermally insulating material wherein said drawer is configured to inhibit thermal communication between the food items in said drawer and ambient air when said drawer is closed;

a pair of rollers, each of said rollers being rotatably coupled to said cooler wherein each of said rollers is configured to roll along a support surface for transporting said cooler along the support surface;

a pull handle being pivotally coupled to said cooler wherein said pull handle is configured to be gripped for rolling said cooler on said pair of rollers;

wherein said cooler has a dividing wall and an outer wall;

wherein said dividing wall has a lip extending upwardly from a top surface of said dividing wall, said lip on said dividing wall extending around a full perimeter of an inside surface of said outer wall; and wherein said mesh grill lies on said lip on said dividing wall such that said mesh grill is spaced from said dividing wall wherein said mesh grill is configured to accommodate ice cubes to be positioned between said mesh grill and said dividing wall.

9. A portable cooler assembly for keeping food items from coming into contact with melted ice, said assembly comprising:

a cooler being comprised of a thermally insulating material wherein said cooler is configured to store ice and food items, said cooler having an upper chamber being fluidly discrete from a lower chamber, said cooler having a pair of first engaging elements, said cooler including a lid;

a pair of first latches, each of said first latches being pivotally coupled to said lid, each of said first latches releasably engaging a respective one of said first engaging elements for retaining said lid in a closed position;

a mesh grill being positioned in said upper chamber in said cooler wherein said mesh grill is configured to have food items placed upon said mesh grill, said mesh grill being spaced upwardly in said upwardly chamber wherein said mesh grill is configured to elevate the food items thereby inhibiting the food items from being exposed to water from melted ice;

a drawer being slidably integrated into said cooler wherein said drawer is configured to contain food items, said drawer being positioned in said lower chamber when said drawer is closed, said drawer being comprised of a thermally insulating material wherein said drawer is configured to inhibit thermal communication between the food items in said drawer and ambient air when said drawer is closed;

a pair of rollers, each of said rollers being rotatably coupled to said cooler wherein each of said rollers is configured to roll along a support surface for transporting said cooler along the support surface;

a pull handle being pivotally coupled to said cooler wherein said pull handle is configured to be gripped for rolling said cooler on said pair of rollers;

wherein said cooler has an outer wall, a front side of said outer wall having an opening extending into said second chamber;

wherein said drawer slides into said opening in said front side of said outer wall of said cooler, a front wall of said drawer lying on a plane being coplanar with said front side of said outer wall of said cooler when said drawer is closed; and wherein said drawer has a pair of second engaging elements each extending away from a front wall of said drawer, each of said second engaging elements including a pair of blocks which are spaced apart from each other and angle toward each other between an upper edge of said front wall and a bottom wall of said blocks associated with said second engaging elements.

10. The assembly according to claim 9, wherein:

said assembly includes a pair of second latches, each of said second latches being pivotally coupled to said front side of said outer wall of said cooler, each of said second latches having a handle being distally positioned with respect to a pivot point of said second latches and a ball being positioned closer to said handle than said pivot point;

each of said second latches is positioned between said pair of blocks associated with a respective one of said second engaging elements on said front wall of said drawer when said drawer is closed and said pair of second latches is moved into a locking position having said ball associated with each of said second latches abutting said bottom end of said pair of blocks associated with said respective engaging element for retaining said drawer in a closed position; and each of said second latches is displaced from said pair of blocks associated with said respective engaging element when said second latches are moved into an unlocked position thereby facilitating said drawer to be opened.

11. The assembly according to claim 1, wherein:

said cooler has an outer wall, said outer wall having a first lateral side and a second lateral side;

said pull handle has a pair of first members each having a first end being pivotally attached to said second lateral side of said outer wall of said cooler, each of said first members having a having section slidably engaging a second section such that each of said first members has a telescopically adjustable length, said pull handle having a second member extending between a second end of each of said pair of first members wherein said second member is configured to be gripped.

12. The portable cooler assembly of claim 1, further comprising:

a front side of said outer wall having an opening extending into said second chamber, said a lid being hingedly coupled to said top edge of said outer wall, each of said first engaging elements extending away from said front side of said outer wall of said cooler, each of said first engaging elements being aligned with said top edge of said outer wall, each of said first engaging elements including pair of blocks which are spaced apart from each other and angle toward each other between said top edge of said outer wall and a bottom end of said blocks, said lid having indicia being printed on a front side of said outer surface of said lid, said indicia comprising a graduated scale defining a ruler, said cooler having a drain extending through said outer wall, said outer wall of said cooler having a pair of handle wells each extending into a respective one of a first lateral side and a second lateral side of said outer wall, said outer wall of said cooler having a pair of wheel wells each being recessed into an intersection between said first lateral side of said outer wall and a respective one of said rear side and said front side of said outer wall, said cooler having a plurality of ridges each extending away from said interior surface of said outer wall, each of said plurality of ridges extending substantially between said top edge of said outer wall and said dividing wall, said plurality of ridges being arranged into a plurality of pairs of ridges, respective ones of said ridges which comprise each of said pairs of ridges being spaced apart from each other, said plurality of pairs of ridges being spaced apart from each other and being evenly distributed between said first lateral side and said second lateral side of said outer wall, said plurality of pairs of ridges including a set of first ridges and a set of second ridges, said set of first ridges being disposed on said rear side of said outer wall, said set of second ridges being disposed on said front side of said outer wall, said dividing wall having a lip extending upwardly from a top surface of said dividing wall, said lip on said dividing wall extending around a full perimeter of said inside surface of said outer wall;

a dividing panel being insertable between respective ones of said set of first ridges and said second ridges for dividing said upper chamber into a first section and a second section wherein said dividing panel is configured to keep beverage containers separated from food items;

a cutting board being integrated into a top surface of said lid, said cutting board being comprised of a resilient material wherein said cutting board is configured to facilitate food to be cut or chopped on said cutting board;

each of said first latches being disposed on a front side of said outer surface of said lid, each of said first latches having a handle being distally positioned with respect to a pivot point of said first latches and a ball being positioned closer to said handle than said pivot point, each of said first latches being positioned between said pair of blocks associated with a respective one of said first engaging elements on said outer wall of said cooler when said lid is closed and said pair of first latches is moved into a locking position having said ball associated with each of said first latches abutting said bottom end of said pair of blocks associated with said respective engaging element for retaining said lid in said closed position, each of said first latches being displaced from said pair of blocks associated with said respective engaging element when said first latches are moved into an unlocked position thereby facilitating said lid to be opened;

a drain being integrated into said outer wall of said cooler, said drain being in fluid communication with said upper chamber in said cooler wherein said drain is configured to drain water from said upper chamber, said drain being actuatable between a closed condition and an open condition;

said mesh grill lying on said lip on said dividing wall such that said mesh grill is spaced from said dividing wall wherein said mesh grill is configured to accommodate ice cubes to be positioned between said mesh grill and said dividing wall;

said drawer sliding into said opening in said front side of said outer wall of said cooler, a front wall of said drawer lying on a plane being coplanar with said front side of said outer wall of said cooler when said drawer is closed, said drawer having a pair of second engaging elements each extending away from said front wall of said drawer, each of said second engaging elements including a pair of blocks which are spaced apart from each other and angle toward each other between an upper edge of said front wall and a bottom wall of said blocks associated with said second engaging elements;

a pair of second latches, each of said second latches being pivotally coupled to said front side of said outer wall of said cooler, each of said second latches having a handle being distally positioned with respect to a pivot point of said second latches and a ball being positioned closer to said handle than said pivot point, each of said second latches being positioned between said pair of blocks associated with a respective one of said second engaging elements on said front wall of said drawer when said drawer is closed and said pair of second latches is moved into a locking position having said ball associated with each of said second latches abutting said bottom end of said pair of blocks associated with said respective engaging element for retaining said drawer in a closed position, each of said second latches being displaced from said pair of blocks associated with said respective engaging element when said second latches are moved into an unlocked position thereby facilitating said drawer to be opened;

a pair of carrying handles, each of said carrying handles being pivotally disposed in a respective one of said handle wells in said outer wall of said cooler wherein each of said carrying handles is configured to be gripped for carrying said cooler, each of said carrying handles having a pair of lateral members each being pivotally coupled to said outer wall of said cooler and a central member extending between said pair of lateral members wherein said central member is configured to be gripped;

each of said rollers being positioned in a respective one of said wheel wells in said outer wall of said cooler; and said pull handle having a pair of first members each having a first end being pivotally attached to said second lateral side of said outer wall of said cooler, each of said first members having a having section slidably engaging a second section such that each of said first members has a telescopically adjustable length, said pull handle having a second member extending between a second end of each of said pair of first members wherein said second member is configured to be gripped.

* * * * *